US011574517B2

(12) United States Patent
Yates

(10) Patent No.: US 11,574,517 B2
(45) Date of Patent: Feb. 7, 2023

(54) BANKNOTE ACCEPTOR FEEDER DEVICE

(71) Applicant: Innovative Technology Limited, Oldham (GB)

(72) Inventor: Jack Yates, Oldham (GB)

(73) Assignee: Innovative Technology Limited, Oldham (GB)

( * ) Notice: Subject to any disclaimer, the term of this patent is extended or adjusted under 35 U.S.C. 154(b) by 412 days.

(21) Appl. No.: 16/448,158

(22) Filed: Jun. 21, 2019

(65) Prior Publication Data

US 2020/0005576 A1 Jan. 2, 2020

(30) Foreign Application Priority Data

Jun. 28, 2018 (GB) ..... 1810616

(51) Int. Cl.

| | |
|---|---|
| ***G07D 11/16*** | (2019.01) |
| ***G07D 11/14*** | (2019.01) |
| ***G07F 19/00*** | (2006.01) |
| *G07D 11/22* | (2019.01) |

(52) U.S. Cl.

CPC ..... *G07D 11/16* (2019.01); *G07D 11/14* (2019.01); *G07F 19/202* (2013.01); *G07D 11/22* (2019.01); *G07D 2211/00* (2013.01)

(58) Field of Classification Search

CPC ..... G07D 11/00; G07D 11/13; G07D 11/14; G07D 11/16; G07D 11/165; G07D 11/18; G07D 11/40; G07D 2211/00; B65H 1/06; B65H 3/00; B65H 3/06; B65H 3/063; B65H 5/00; B65H 5/006; B65H 5/068; B65H 29/125; B65H 29/14; B65H 31/02; B65H 2301/4212; B65H 2301/4213; B65H 2405/10; B65H 2405/11; B65H 2701/1912

See application file for complete search history.

(56) References Cited

U.S. PATENT DOCUMENTS

| | | | | |
|---|---|---|---|---|
| 4,232,860 A * | 11/1980 | Brown | ..... | B65H 3/063 271/119 |
| 2004/0217536 A1 | 11/2004 | Isobe et al. | | |
| 2010/0289212 A1* | 11/2010 | Nireki | ..... | G07F 7/04 271/254 |

(Continued)

FOREIGN PATENT DOCUMENTS

| | | |
|---|---|---|
| EP | 2053567 A2 | 4/2009 |
| EP | 2793198 A1 | 10/2014 |
| WO | WO 02/33666 A1 | 4/2002 |

*Primary Examiner* — Thien M Le
*Assistant Examiner* — April A Taylor
(74) *Attorney, Agent, or Firm* — Woodard Emhardt Henry Reeves & Wagner LLP

(57) ABSTRACT

A banknote feeder device (3) configured to interconnect and operate in conjunction with a banknote acceptor apparatus (2), the banknote feeder device (3) comprising a banknote transport mechanism operable, when the banknote feeder device (3) is connected to the banknote acceptor apparatus (2), to transport a banknote from a banknote input aperture to a banknote output aperture. The banknote transport mechanism comprises a linear succession of spaced-apart pairs of transport wheels (22) and each transport wheel extends at least partially through a banknote transport conduit surface into an interior cavity of the banknote transport conduit between the banknote input aperture and the banknote output aperture.

6 Claims, 6 Drawing Sheets

(56) References Cited

U.S. PATENT DOCUMENTS

| | | | | |
|---|---|---|---|---|
| 2011/0114441 | A1* | 5/2011 | Seki | G07F 7/04 194/206 |
| 2020/0286322 | A1* | 9/2020 | Cost | G07D 11/16 |

* cited by examiner

BANKNOTE ACCEPTOR FEEDER DEVICE

Conventional banknote acceptors and banknote validators typically receive banknotes one at a time through a bezel arrangement input aperture. Recently, it has become a more frequent requirement for banknote apparatus to be capable of receiving more than one banknote at a time. A typical application may require that a banknote acceptor be adapted to receive a plurality of banknotes in the form of a banknote bundle.

A prior art approach to the problem of enabling a banknote apparatus to receive banknotes in the form of a bulk bundle is disclosed in EP-B-2,070,059. Here, a banknote handling apparatus comprises, inter alia, a banknote acceptor module detachably connected to a bulk feeder module. The bulk feeder module replaces a conventional bezel arrangement and is adapted to connect with a banknote tray.

The banknote tray of EP-B-2,070,059 is divided into separate upper and lower bin compartments. The lower bin is configured to receive an input bundle of banknotes, and the upper bin receives banknotes that have been rejected by validation means housed within the banknote acceptor module. When a bundle of banknotes is inserted into the lower bin, a feeder pinch arm arrangement exerts downward pressure on the bundle of banknotes. When the lower bin is empty, the pinch feeder pinch arm arrangement retracts.

Single banknotes are stripped from the top of the input bundle of banknotes via the friction action of a feeder pulley activated and driven by a bulk feeder module drive motor. A high friction drive pulley operating in conjunction with one or more stripper belts ensures that only a single banknote enters the transport path of the bulk feeder module during drive motor activation. A start/stop sensor is provided to turn the drive motor on and off.

A problem exists with the conventional bulk feeder module of EP-B-2,070,059 in that the module requires a complex arrangement of components to feed singulated banknotes from an input bundle of banknotes. Namely, a feeder pinch arm, a feeder pulley, a drive pulley, and stripper belts. Furthermore, an additional problem exists in that banknotes cannot be added to the initial bundle of banknotes during an input operation. A user must wait until the lower bin is empty of banknotes before any further banknotes can be inserted.

The present invention seeks to overcome the problems associated with the above described prior art bulk feeder module.

According to an aspect of the present invention there is provided a banknote feeder device as defined in accompanying claim 1.

Preferably, each wheel of each said pair of transport wheels is mounted eccentrically to a respective common axle of the pair of transport wheels.

Preferably, the banknote transport conduit extends in a substantially longitudinal direction of the banknote feeder device, and the banknote transport conduit is delimited in a direction perpendicular to the longitudinal direction by an upper passageway surface and an opposing lower passageway surface. The upper passageway surface includes a protrusion extending away from the upper passageway towards the lower passageway surface to form a pinch point in the banknote transport conduit.

Preferably, the pinch point is located at a position in the banknote transport conduit proximal to the banknote output aperture, and the protrusion is located between a pair of resiliently biased guide members.

Preferably, each resiliently biased guide member of the pair of guide members is a ski-shaped nylon runner, and each transport wheel of the succession of spaced-apart pairs of transport wheels is fabricated from a thermoplastic polyurethane material.

Preferably, the banknote transport mechanism includes a truncated feed wheel opposing an input/output feed wheel proximal to the banknote output aperture, and the truncated feed wheel includes a pair of diametrically opposed flat faces.

Preferably, the input/output feed wheel is resiliently biased.

An embodiment of the present invention will now be described, by way of example only, with reference to the accompanying schematic drawings, in which.

Figure 1:
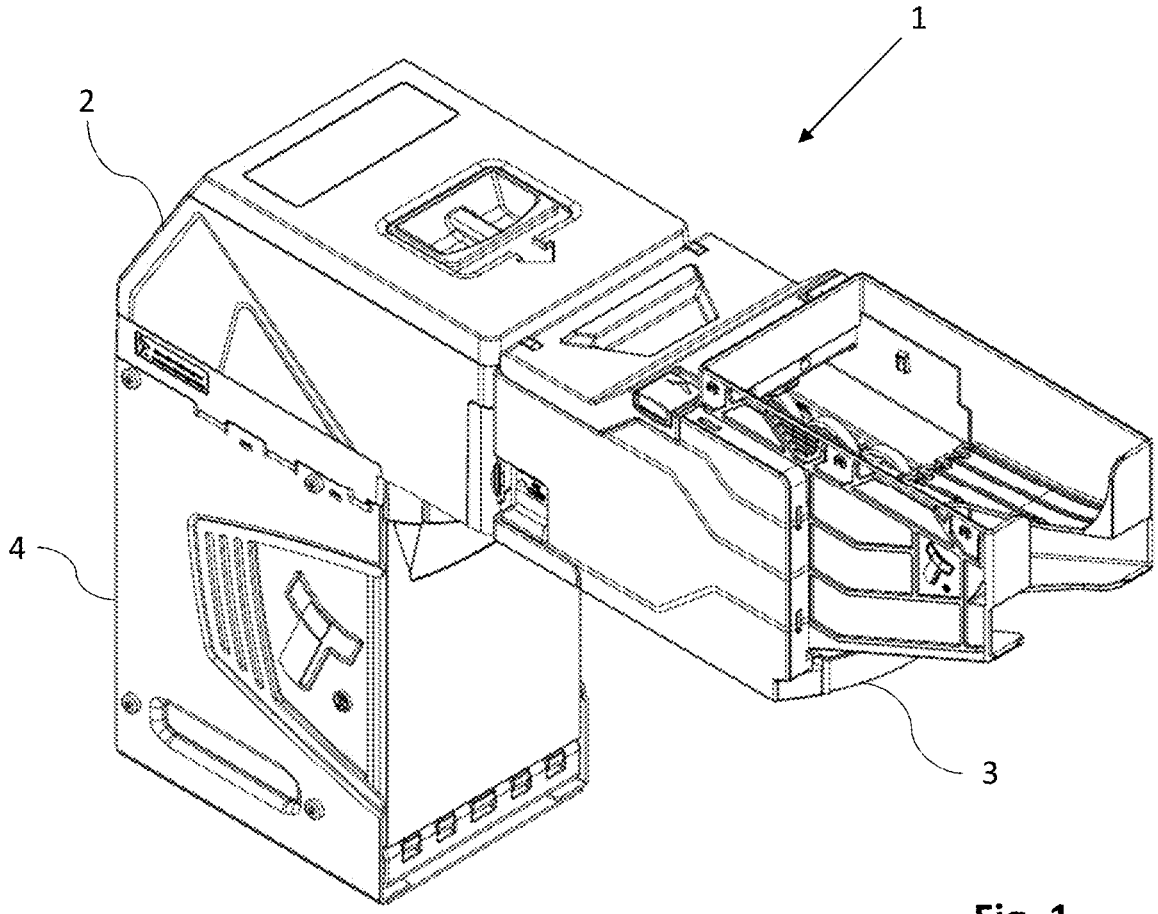
FIG. 1 shows a perspective view of a banknote apparatus including a banknote feeder device according to the present invention.

With reference to FIG. 1, a banknote apparatus 1 comprises a banknote acceptor module 2, a banknote cashbox 4, and a detachable banknote feeder device 3. The banknote acceptor module 2 and the banknote cashbox 4 are banknote apparatus components that are well known in the art and no further description or explanation of either is considered necessary here.

Figure 2:
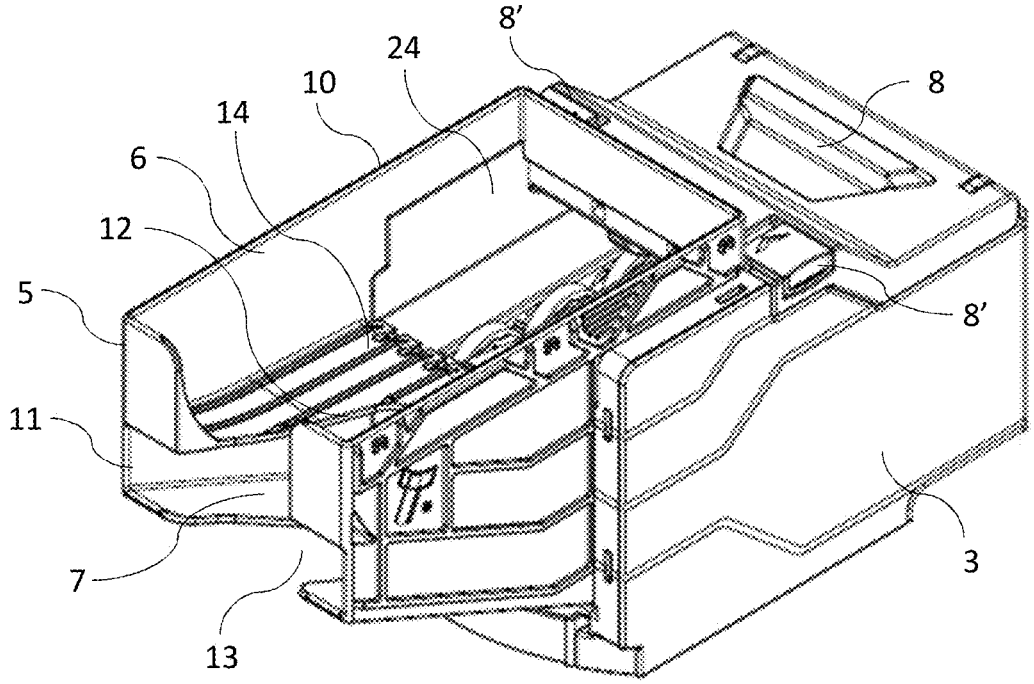
FIG. 2 shows a perspective view of a banknote feeder device according to the present invention.

FIG. 2 shows the banknote feeder device 3 detached from the banknote acceptor module 2 of the banknote apparatus of FIG. 1. The banknote feeder device 3 comprises a banknote tray module 5 and a feeder mechanism module 3'. The feeder mechanism module 3' is detachable from the acceptor module 2 by operation of a feeder device release mechanism 8. In a similar manner, the banknote tray module 5 is in turn detachable from the feeder mechanism module 3' via operation of a tray module release mechanism 8' [see FIG. 3].

The banknote tray module 5 comprises a banknote input compartment 6 and a banknote output compartment 7. The banknote input compartment 6 is open to the exterior of the banknote feeder device 3 via an input compartment opening 10. The input compartment 6 communicates directly with a feeder mechanism input chamber 24. The input chamber 24 is delimited by opposing feeder mechanism module walls 24' [see FIG. 3] and is connectable to an input compartment deck section 14 that forms the base of the banknote input compartment 6 of the banknote tray module 5.

The banknote output compartment 7 includes an output aperture 11 disposed at a front section of the banknote tray module 5. The output aperture 11 provides an opening that is in a position substantially orthogonal to the position of the input compartment opening 10.

The input compartment deck section 14 of the banknote input compartment 6 includes a cutaway portion 12. An opposing cutaway portion 13 is provided in a base section of the banknote output compartment 7. The pair of cutaway portions 12, 13 facilitate the easy loading and retrieval of banknotes from the banknote input compartment 6 and the banknote output compartment 7 respectively.

Figure 3:
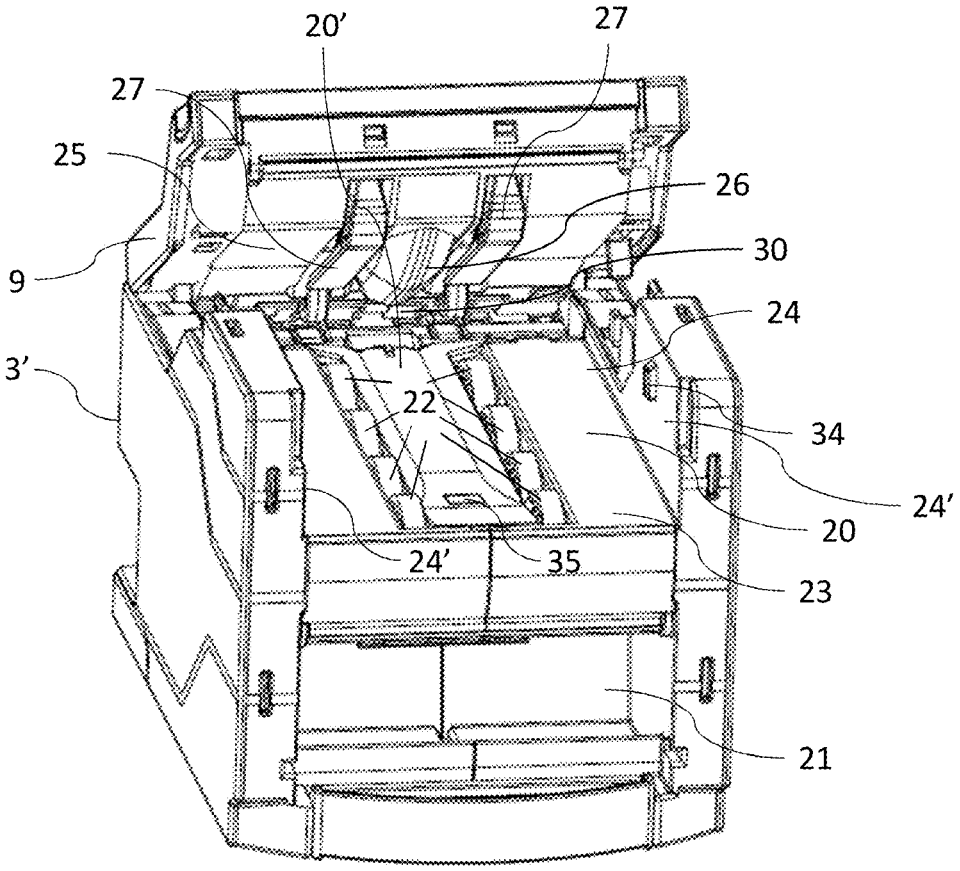
FIG. 3 shows the banknote feeder device with the cover section in an open position.

FIG. 3 shows the feeder mechanism module 3' of the present invention detached from the banknote acceptor module 2 and with the banknote tray module tray 5 detached from the feeder mechanism module 3'. In FIG. 3 a cover section 9 is shown in an open position exposing the interior of the feeder mechanism module 3'. A banknote input pathway 20 extends rearwardly from the input chamber 24 towards a banknote acceptor communication aperture 30. As noted above, the input chamber 24 is flanked by the pair of opposing walls 24' and comprises an input pathway lower surface 23. The input pathway lower surface 23 extends the entire length of the banknote input pathway 20.

The cover section 9 of the feeder mechanism module 3' includes, at an underside section opposite the input pathway lower surface 23, an input pathway upper surface 25. The input chamber 24 is enclosed on three sides by a forward portion of the input pathway lower surface 23 and the pair of opposing chamber walls 24'. When the cover section 9 is in a closed position, a rearward section of the banknote input pathway 20 is delimited by the input pathway upper surface 25 and a section of the input pathway lower surface 24 that is proximal to the banknote acceptor communication aperture 30.

Positioned below the input chamber 24 is an output chamber 21 which, when the banknote tray module 5 is attached to the feeder mechanism module 3, communicates with the banknote output compartment 7.

As shown in FIG. 3, the feeder module 3' includes a banknote drive mechanism comprising a plurality of transport wheels 22 partially projecting through the input pathway lower surface 23 into the interior of the banknote input pathway 20. The transport wheels are arranged as spaced-apart pairs of wheels that form a linear succession of transport wheels running substantially the length of the banknote input pathway 20. The succession of wheels extends from an aperture formed by the opposing pair of input chamber walls 24' to a position proximal to the banknote acceptor communication aperture 30.

The input pathway lower surface 23 includes, at a position midway between the opposing pair of chamber walls 24' and proximal to the aperture formed by the walls, art optical input sensor 35. A further pair of optical input sensors 34 are positioned on opposing surfaces of the chamber walls [only one is shown in FIG. 3]. The combination of optical sensors 34, 35 provide an indication of when a bundle of banknotes has been loaded into the banknote feeder device 3 and when the input bundle of banknotes has been depleted indicating that the banknote input compartment 6 is empty.

The input pathway upper surface 25 includes a protrusion 26 which projects downwardly away from the input pathway upper surface 25 towards the input pathway lower surface 23. The protrusion 26 is positioned between a pair of resiliently biased guide members 27. Each guide member is positioned opposite a corresponding line of transport wheels 22.

Figure 4:
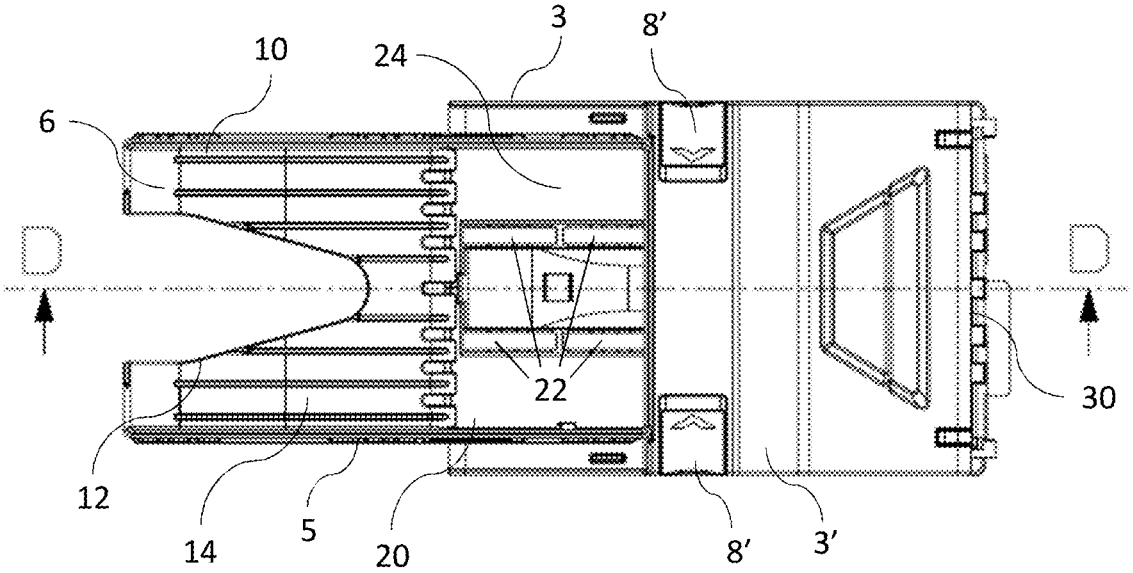
FIG. 4 shows a plan view of the banknote feeder device.

FIG. 4 shows a plan view of the banknote feeder device 3 of the present invention detached from the banknote acceptor module 2 shown in FIG. 1. In FIG. 4 the banknote tray module 5 is shown attached to the feeder mechanism module 3', and the relationship between the input compartment deck section 14, the banknote input pathway 20, and the input chamber 24 is clearly visible.

Figure 4A:
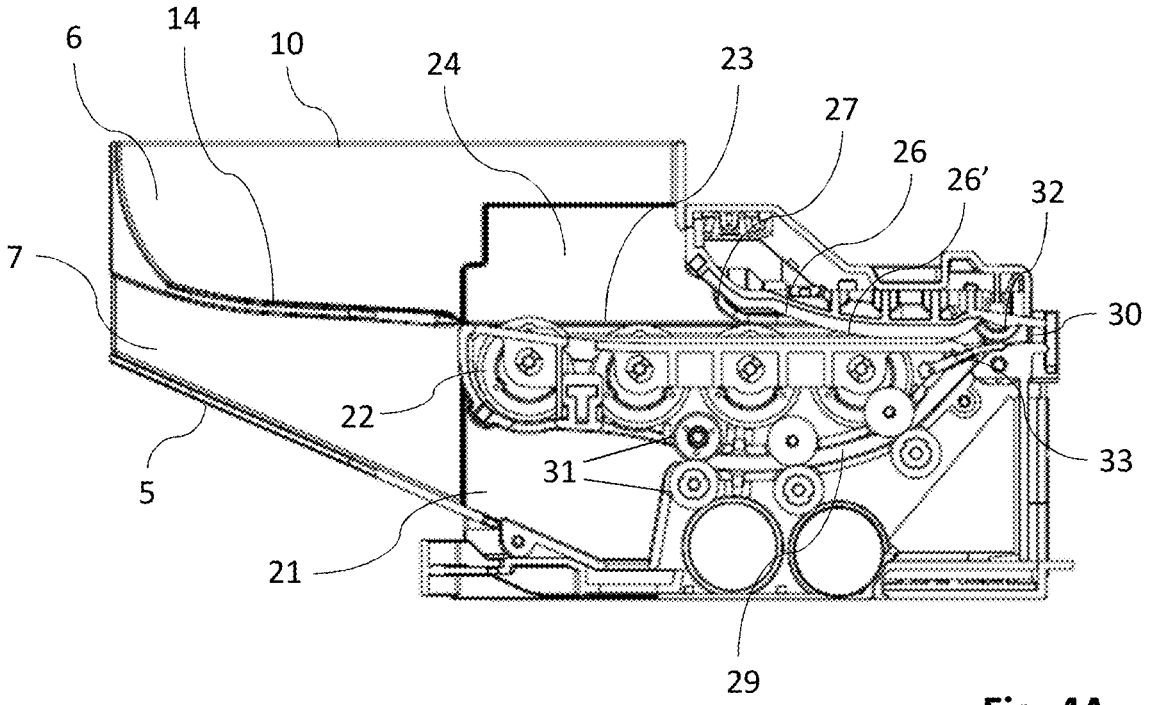
FIG. 4A is a sectional view of the banknote feeder device along the line D-D shown in FIG. 4.

FIG. 4A shows a cross-sectional view of the banknote feeder device 3 along the line D-D shown in FIG. 4. This line cuts directly through a centre section of the protrusion 26.

As can be seen from FIG. 4A, the input compartment deck section 14 has a shallow incline from the front of the banknote input compartment 6 towards the input pathway lower surface 23. This incline ensures that an input banknote bundle [see 16 of FIG. 5A] has a slight rhomboid shape which assists with stripping a single banknote from the underside of the banknote bundle 16.

The banknote output compartment 7 is inclined in an upward manner with respect to the horizontal away from the output chamber 21 towards a front portion of the banknote tray module 5.

The input pathway lower surface 23 extends rearward past the succession of transport wheels 12 towards a pinch point 26' in the banknote input pathway 20. The pinch point 26' is formed by the protrusion 26 projecting downwards to a point very close to a central portion 20' [see FIG. 3] of the banknote input pathway 20. The pinch point 26' forms a choke region in the banknote input pathway 20 that is dimensioned to allow only a single banknote to pass in a downstream direction. The protrusion 26 is fabricated form a material with a higher coefficient of friction than that of the resiliently biased guide members 27. For example, the resiliently biased guide members 27 may be fabricated from smooth nylon.

A banknote traversing the pinch point 26' is transported passed a diverter device 33 by continued operation of the transport wheels to engage with input/output feed wheels 32 which then direct the banknote through the banknote acceptor communication aperture 30 to be received by a further transport mechanism housed within a banknote acceptor module 2 [not shown].

In a reverse manner, a banknote fed from the banknote acceptor module to the banknote feeder device 3 is received via the banknote acceptor communication aperture 30 and is engaged by the input/output feed wheels 32. The diverter device 33 is moved upwards such that access to a banknote egress channel 29 is open. The outgoing banknote is then transported through the banknote egress channel 29 by a series of banknote egress drive wheels 31 and deposited into the collection space formed by the combination of the output chamber 21 and the banknote output compartment 7. This operation is repeated until the banknote output compartment 7 contains a bundle of banknotes comprising the requisite number of notes.

Figure 5:
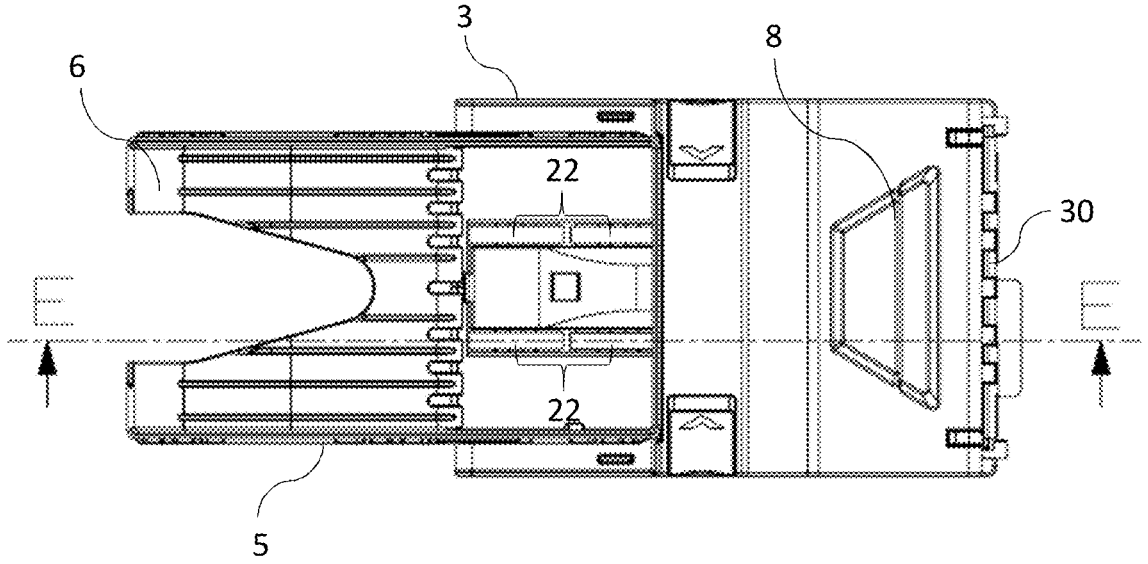
FIG. 5 shows a plan view of the banknote feeder device.

FIG. 5 shows a plan view of the banknote feeder device 3 of the present invention detached from the banknote acceptor module 2 shown in FIG. 1.

Figure 5A:
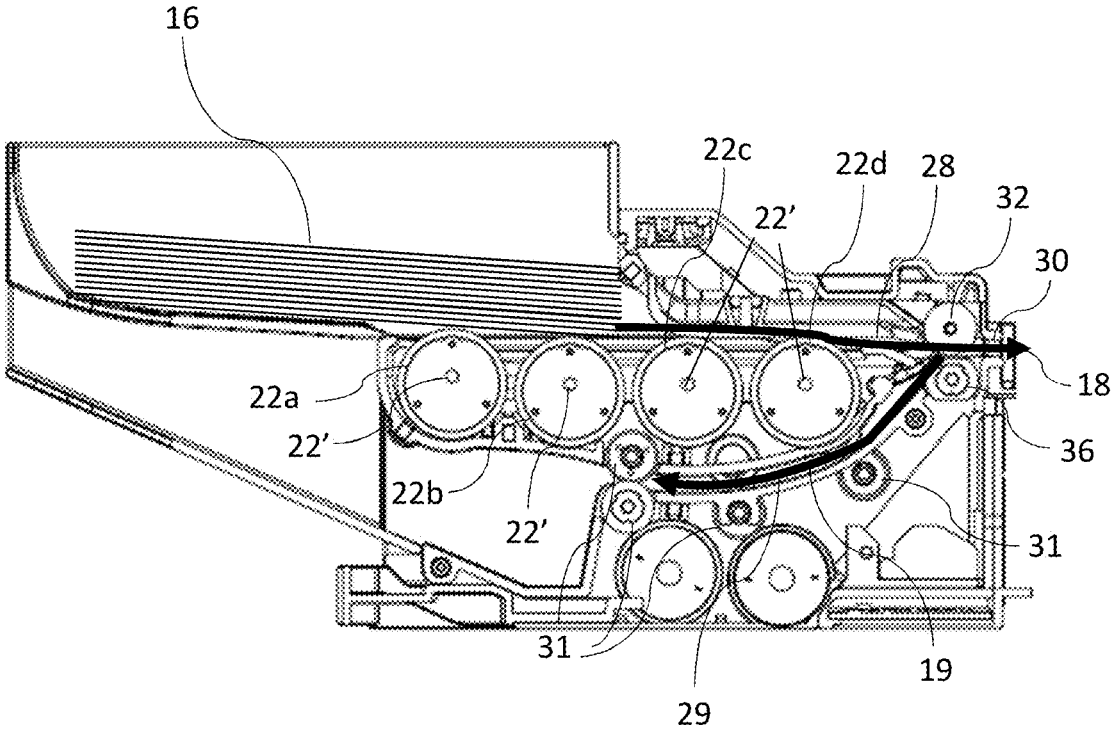
FIG. 5A is a sectional view of the banknote feeder device along the line E-E shown in FIG. 5.

FIG. 5A is cross-sectional view of the banknote feeder device 3 along the line E-E shown in FIG. 5. The line E-E cuts directly through the centre of one of the pairs of resiliently biased guide members 27 and a corresponding line of transport wheels 22.

FIG. 5A shows a deposited banknote bundle 16 in the banknote input compartment 6. Further explanation of a banknote input operation will be described with reference to this Figure.

One wheel from each of the pairs of wheels 22 is shown in FIG. 5A and, for simplicity and clarity, these have been relabeled 22*a* to 22*d*. Each wheel 22*a* to 22*d* is eccentrically mounted to an axle 22'. The reader will be aware that the corresponding wheel for each opposing wheel of the wheel pairs will also be mounted eccentrically to the shared axle 22'. The arrows shown in FIG. 5A indicate the direction of input banknotes and output banknotes.

During operation of the banknote feeder device 3, the transport wheels 22*a* to 22*d* are activated and motor driven. Preferably, the transport wheels 22*a* to 22*d* are manufactured from an elastomeric material such as thermoplastic polyurethane. Since the transport wheels are mounted eccentrically, the revolution of the wheels will be irregular and elliptical in form. Consequently, as the bottom banknote of the banknote bundle 16 is transported towards a banknote ingress channel 28 of the banknote pathway 20, the banknote bundle 6 is jiggled such that the lowest banknote of the banknote bundle 16 is transported horizontally by successive wheel pairs 22*a* to 22*d*, whilst also being displaced slightly in a reciprocating manner in an orthogonal direction. The topmost banknote of the banknote bundle 16 is in contact with the pair of resiliently biased guide members 27 and these are adapted to follow the reciprocating jiggling motion of the banknote bundle 16 due to their resiliently biased nature.

An upper surface of a leading-edge portion of the topmost banknote of the banknote bundle 16 is also in contact with the protrusion 26. As this banknote is moved forward it will be stopped by the pinch point 26'. Advantageously, since the contact area of the transport wheels 22*c* and 22*d* on the lowest banknote of the banknote bundle 16 is lower than the contact area of the protrusion 26 on the uppermost banknote of the banknote bundle 16, a shearing action is applied to the banknote bundle 16 facilitating singulation of the lowest banknote from the banknote bundle 16.

Figure 6:
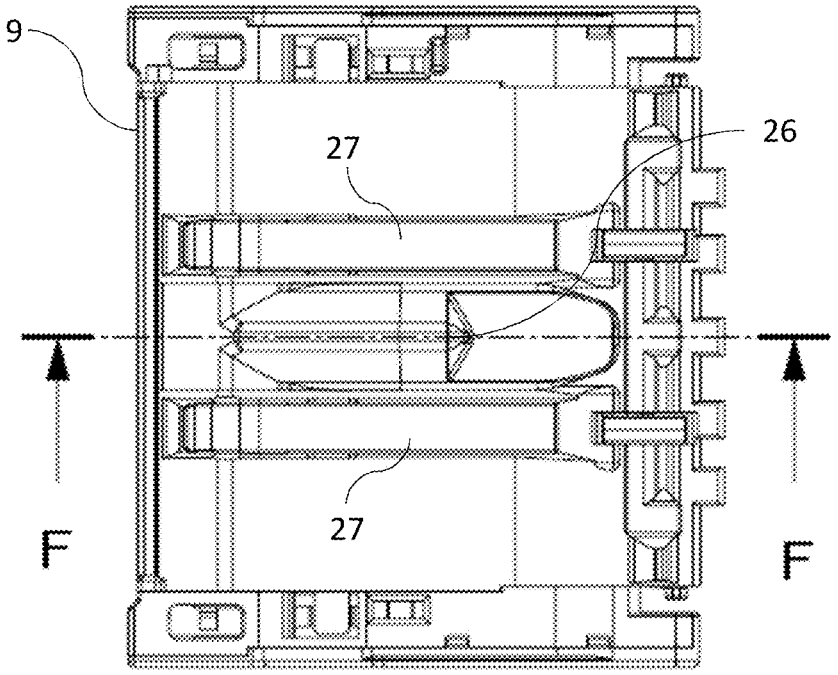
FIG. 6 shows a plan view of the banknote feeder device with the input/output module and cover section removed.

FIG. 6 shows a plan view of the underside of the cover section 9. As shown, the protrusion 26 is centrally positioned between the pair of resiliently biased guide members 27.

Figure 6A:
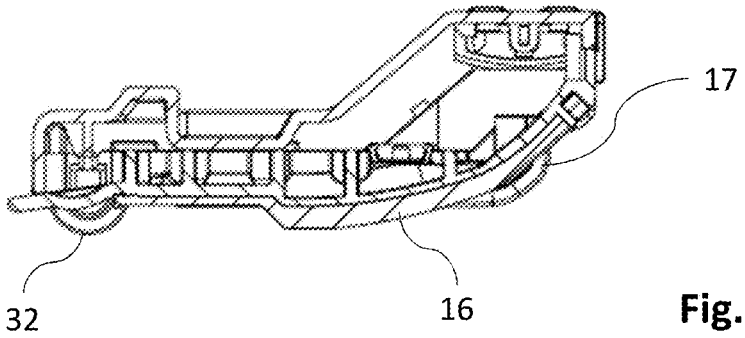
FIG. 6A is a partial sectional view of the banknote feeder device along the line F-F shown in FIG. 6.

FIG. 6A shows a sectional elevation view along the line F-F shown in FIG. 6. The protrusion 16 has an arcuate shape and extends below the default position of the guide member 17. Transport feed wheel 32 is resiliently biased, or spring-loaded, and is positioned in line with the guide member 17 at a position rearward of the protrusion 16.

Figure 7:
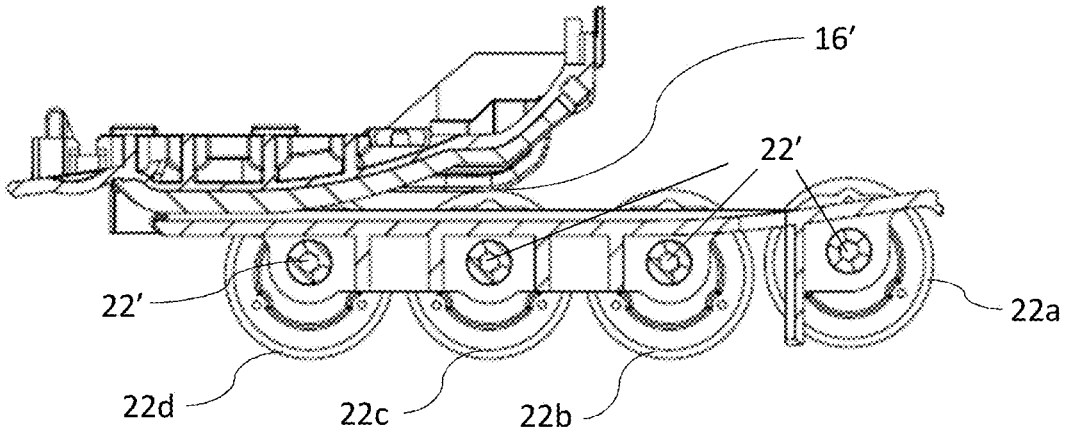
FIG. 7 is a sectional detail showing the spatial arrangement of the protrusion and the transport wheels.

FIG. 7 shows a partial sectional view showing the positional relationship between the protrusion pinch point 16' and the succession of transport wheels 22*a* to 22*d*. The sectional view also clearly illustrates that the transport wheels are all respectively mounted in an eccentric arrangement.

Figure 8:
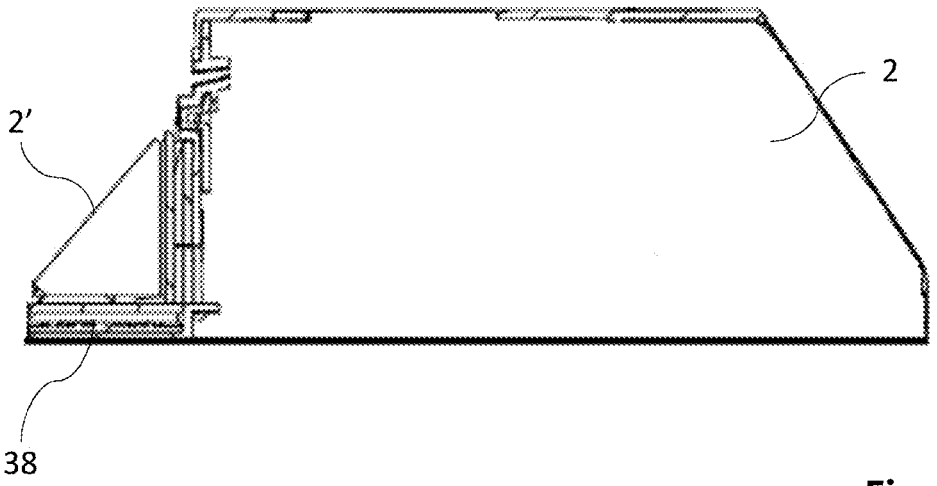
FIG. 8 is a side elevation view of a banknote acceptor module with the banknote feeder device and cashbox removed.

FIG. 8 shows an elevation view of a banknote acceptor module 2. The banknote acceptor module 2 includes a banknote feeder device mounting bracket 2'. The banknote feeder device mounting bracket 2' is configured to releasably engage with a banknote feeder device 3 of the present invention.

The banknote feeder device mounting bracket 2' includes a control unit 38 which incorporates a processor (not shown) for controlling the operation of the banknote feeder device 3.

Figure 9:
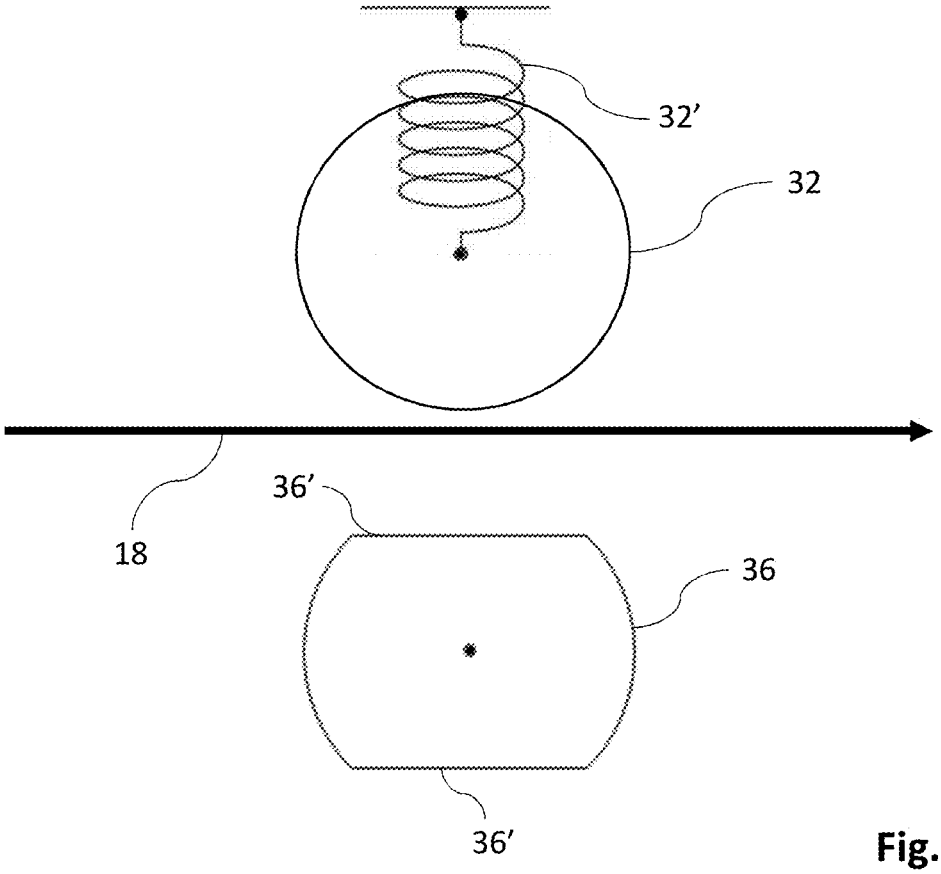
FIG. 9 is a simplified sectional view of a feed wheel arrangement.

FIG. 9 shows a simplified schematic showing the relationship between the input/output feeder wheel 32 and a truncated feed wheel 36.

In operation, when a banknote is being fed from the banknote feeder device 3 to the banknote acceptor module 2 in the banknote egress direction 18, travels between the input/output feeder wheel 32 and the truncated feed wheel 36. The input/output feed wheel 32 is resiliently biased in a direction perpendicular to the banknote egress direction 18 via the employment of a biasing spring 32'. In this way, the input/output feed wheel 32 is configured to follow the vertical movement of the resiliently biased guide members 27.

Figure 10:
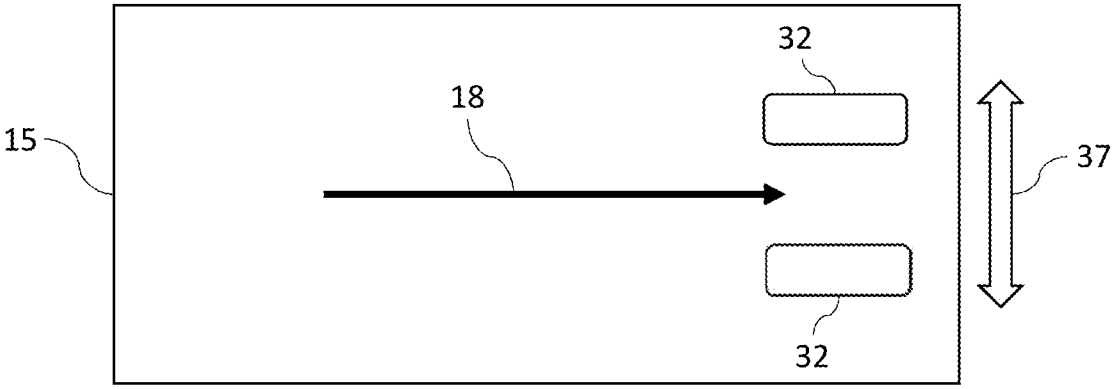
FIG. 10 is a simplified plan view of the egress of a banknote through the feed wheel arrangement of FIG. 9.

The truncated feed wheel 36 includes two diametrically opposing flat faces 36'. When the leading edge of a banknote 15 (see FIG. 10) reaches a banknote egress sensor (not shown) the control unit 38 issues an electronic control signal such that the truncated feed wheel 36 is held stationary in the position shown in FIG. 9. It should be noted that the distance between the truncated feed wheel 36 and the input/output feed wheel 32 will be of the order of the thickness of the banknote 15 and that the figure shows and exaggerated view for clarity only.

When the banknote 15 enters the banknote acceptor module 2 it may be necessary to straighten the orientation of the banknote 15 in the lateral direction 37. Advantageously, the flat faces 36' of the truncated feed wheels 36 allow for this lateral movement (see FIG. 9).

The invention claimed is:

1. A banknote feeder device configured to interconnect and operate in conjunction with a banknote acceptor apparatus, the banknote feeder device comprising:

a banknote input aperture and a banknote output aperture interconnected by a banknote transport conduit, and a banknote transport mechanism operable, when the banknote feeder device is connected to said banknote acceptor apparatus, to transport a banknote from said banknote input aperture to said banknote output aperture;

characterised in that said banknote transport mechanism comprises a linear succession of spaced-apart pairs of transport wheels, wherein each wheel of each said pair of transport wheels extends at least partially through a banknote transport conduit surface into an interior cavity of said banknote transport conduit between the banknote input aperture and the banknote output apertures;

wherein each wheel of each said pair of transport wheels is mounted eccentrically to a respective common axle of the pair of transport wheels;

wherein the banknote transport conduit extends in a substantially longitudinal direction of the banknote feeder device, and the banknote transport conduit is delimited in a direction perpendicular to the longitudinal direction by an upper passageway surface and an opposing lower passageway surface;

wherein the upper passageway surface includes a protrusion extending away from the upper passageway surface towards the lower passageway surface to form a pinch point in the banknote transport conduit;

wherein the protrusion is located between a pair of resiliently biased guide members; and wherein each resiliently biased guide member of the pair of guide members is a ski-shaped runner.

2. A banknote feeder device as claimed in claim 1, wherein the pinch point is located at a position in the banknote transport conduit proximal to the banknote output aperture.

3. A banknote feeder device as claimed in claim 1, wherein each resiliently biased guide member of the pair of guide members is a ski-shaped nylon runner.

4. A banknote feeder device as claimed in claim 1, wherein each transport wheel of the succession of spaced-apart pairs of transport wheels is fabricated from a thermoplastic polyurethane material.

5. A banknote feeder device as claimed in claim 1, wherein the banknote transport mechanism includes a truncated feed wheel opposing an input/output feed wheel proximal to the banknote output aperture, and wherein said truncated feed wheel includes a pair of diametrically opposed flat faces.

6. A banknote feeder device as claimed in claim 5, wherein said input/output feed wheel is resiliently biased.

* * * * *